US005395202A

United States Patent [19]

Peters

[11] Patent Number: 5,395,202

[45] Date of Patent: Mar. 7, 1995

[54] CAMPER CABIN SUPPORTING AND LIFTING APPARATUS

[76] Inventor: Frank D. Peters, P. O. Box 1743, Kenai, Ak. 99611

[21] Appl. No.: 908,049

[22] Filed: Jul. 6, 1992

[51] Int. Cl.[6] ..... B66F 7/26

[52] U.S. Cl. ..... 414/495; 414/498; 296/164; 254/45

[58] Field of Search ..... 414/347, 458, 495, 498, 414/678; 296/164; 254/45

[56] References Cited

U.S. PATENT DOCUMENTS

| | | | |
|---|---|---|---|
| 2,995,397 | 8/1961 | Eames | 296/164 |
| 3,135,407 | 6/1964 | Back | 254/45 X |
| 3,599,817 | 8/1971 | Bergman, Jr. | 414/498 |
| 3,658,376 | 4/1972 | Dodgen et al. | 414/498 X |
| 3,672,524 | 6/1972 | Conrad | 414/498 |
| 3,697,044 | 10/1972 | Kowalski | 414/498 X |
| 3,715,100 | 2/1973 | Spencer | 414/498 X |
| 3,719,384 | 3/1973 | du Bois | 414/495 X |
| 3,786,951 | 1/1974 | Ruff et al. | 414/495 |
| 3,836,030 | 9/1974 | Timmons | 254/45 X |
| 3,881,689 | 5/1975 | Bury et al. | 254/45 |
| 3,980,313 | 9/1976 | Meinecke, Jr. | 296/164 |
| 4,155,471 | 5/1979 | Yancy | 414/458 X |
| 4,314,726 | 2/1982 | Artweger et al. | 296/164 |
| 4,723,744 | 2/1988 | Baker, Jr. et al. | 254/45 X |

*Primary Examiner*—Michael S. Huppert
*Assistant Examiner*—James Keenan
*Attorney, Agent, or Firm*—Donald A. Kettlestrings

[57] ABSTRACT

Apparatus for supporting and lifting a wheelless, vehicle-mounted camper cabin includes built-in jacks for safely, quickly and easily loading and unloading the camper cabin with respect to a transporting vehicle. The apparatus can be attached to the camper cabin and suspended therefrom when the camper cabin is mounted on a vehicle, and the apparatus can be used to secure the camper cabin on the transporting vehicle, while eliminating the need for tie-down chains, turnbuckles or other inconvenient means of securing the camper cabin to the transporting vehicle. The apparatus can include wheels for enabling the camper cabin to be moved about when the cabin has been removed from the vehicle and supported by the apparatus. The apparatus is also very stable to permit safe occupancy of the camper cabin when the cabin has been off-loaded from the vehicle and supported by the apparatus.

18 Claims, 3 Drawing Sheets

11
24
20'
62
16'
68'
38
34'
50'
56'
46'
40'
58
30'
68
36
18'
14'
56
54
26
42'
62
42
32
18
62

CAMPER CABIN SUPPORTING AND LIFTING APPARATUS

This invention relates to a support and lift for a wheelless, vehicle-mounted camper cabin and more particularly to such a support and lifting apparatus which makes loading, unloading, support and transporting of campers safe, fast and easy.

Various types of camper supports and lifting devices are known. Although such devices have served the purpose, they have not proved entirely satisfactory because they are often unstable and may cause damage to the camper.

Many campers are equipped with jacks mounted at the corners of the camper. Some require the use of portable jacks or cable lifts on each side of the camper to unload or load the camper onto a pickup truck. Jacks that are mounted on the corners of existing campers are typically single pole jacks that put extreme stress onto the camper at their mounting points. Such single pole jacks are inherently unstable and they are commonly bent from frequent use.

When campers are unloaded from a pickup truck and when the campers are supported on conventional jacks, the campers must typically be supported underneath with barrels or blocks because the jacks are unstable. Without the additional barrels or blocks to support the campers, existing jacks are unsafe, and the camper is not properly stabilized by the jacks alone. Many older campers have no mounted jacks, and separate jacks must be used.

It is, therefore, an object of the present invention to provide apparatus for supporting and lifting a wheelless, vehicle-mounted camper cabin.

Another object is to provide such apparatus which makes loading, unloading and supporting of a camper faster, easier and more stable.

A further object of the invention is the provision of such apparatus which will support a camper in an extremely stable condition when the camper is not mounted on a pickup truck.

Still another object is to provide such apparatus which is sufficiently stable to permit safe occupancy without additional supports or blocks when the camper has been removed from a pickup truck.

A still further object is to provide such apparatus which will not damage the camper.

Another object is to provide Such apparatus which can be attached to the camper and transported with the camper by the pickup truck.

Another object is to provide such apparatus which can be attached to the camper and which will raise up beneath the pickup truck to firmly hold or lock the camper in position on the pickup truck for transporting the camper.

Still another object is to provide such apparatus which can be used to adjust the side-to-side level of the camper while the camper is mounted on a truck and when the camper has been off-loaded from a truck.

A further object of the invention is the provision of such apparatus which makes it possible to easily move the apparatus and the camper around while the camper is not mounted on the vehicle.

Another object is to provide such apparatus which is adjustable in length and in width to accommodate vehicles of different sizes.

Another object is to provide such apparatus which includes two built-in jacks for quickly and safely raising and lowering a camper.

Another object is to provide such apparatus which can be quickly and easily disassembled for storage or transportation.

Yet another object of the present invention is the provision of such apparatus which is adjustable in size to fit wheelless, vehicle-mounted campers of different sizes.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides apparatus for supporting and lifting a wheelless, vehicle-mounted camper cabin, the apparatus comprising: first and second opposed base members; first and second vertical supports extending upwardly from the first base member; third and fourth vertical supports extending upwardly from the second base member; first and second sleeve members telescopically positioned with respect to the first and second supports, respectively; third and fourth sleeve members telescopically positioned with respect to the third and fourth supports, respectively; a first support element extending between the first and second sleeve members; a second support element extending between the third and fourth sleeve members; first jack means in operative relationship with the first support element for raising and lowering the first support element; second jack means in operative relationship with the second support element for raising and lowering the second support element; and first and second transverse members extending between the base members.

The first jack means is in operative relationship between the first support element and the first base member for raising and lowering the first support element with respect to the first base member, and the second jack means is in operative relationship between the second support element and the second base member for raising and lowering the second support element with respect to the second base member.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
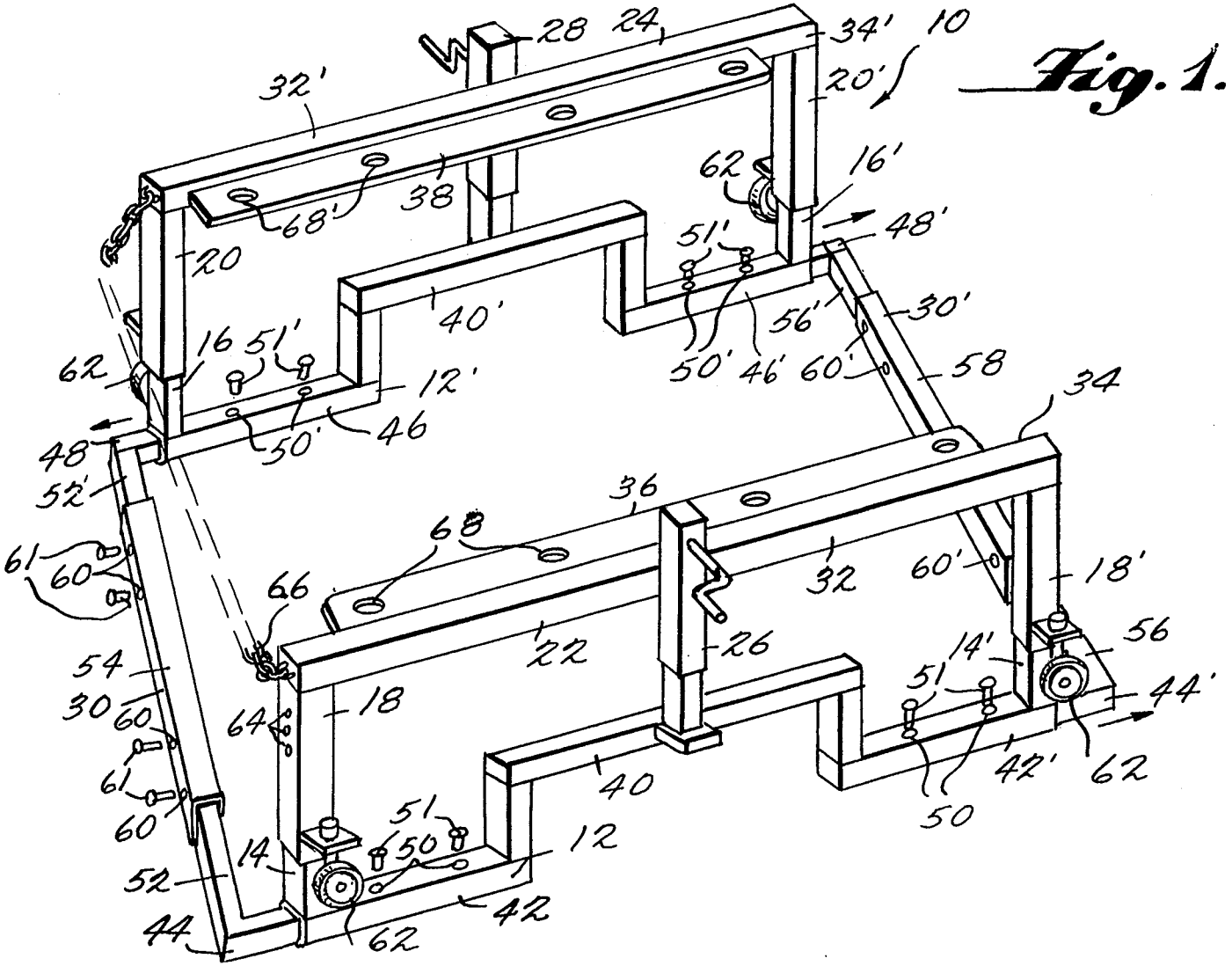
FIG. 1 is a perspective view of the apparatus.
Figure 2:
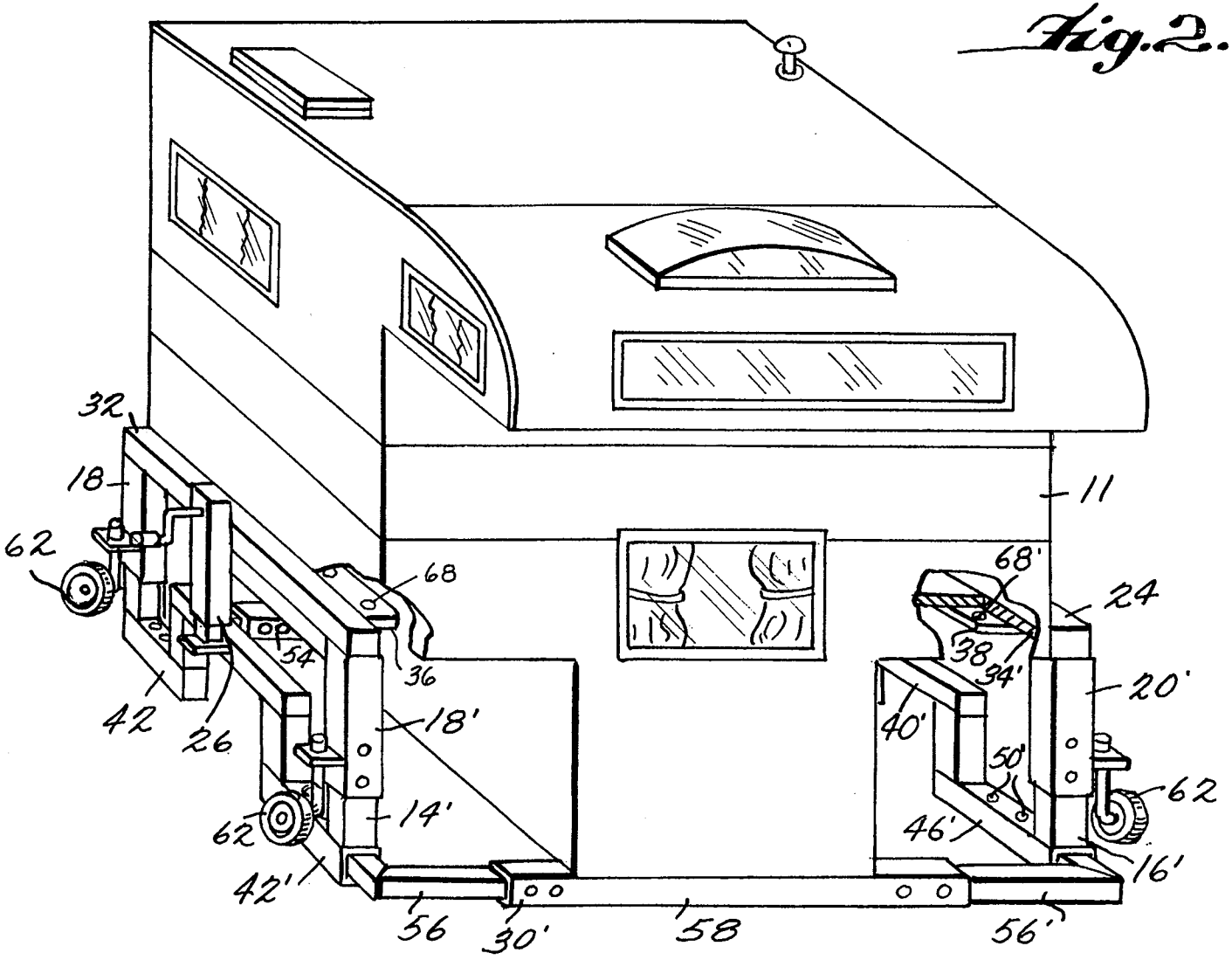
FIG. 2 is a perspective view of the apparatus supporting a camper cabin.

With reference now to the drawings, wherein like reference characters designate like or corresponding parts throughout the several views, there is shown apparatus 10 for supporting and lifting a wheelless, vehicle-mounted camper cabin 11. Apparatus 10 includes first and second opposed base members 12, 12'. First and second vertical supports 14, 14' extend upwardly from first base member 12, and third and fourth vertical supports 16, 16' extend upwardly from second base member 12'.

First and second sleeve members 18, 18' are telescopically positioned with respect to supports 14, 14', respectively. Third and fourth sleeve members 20, 20' are telescopically positioned with respect to supports 16, 16' respectively.

A first support element 22 extends between sleeve members 18, 18', and a second support element 24 extends between sleeve members 20, 20'.

First jack means 26 is positioned in operative relationship with support element 22 for raising and lowering support element 22, and second jack means 28 is positioned in operative relationship with support element 24 for raising and lowering support element 24. First and second transverse members 30, 30' extend between base members 12, 12'.

First jack means 26 is connected in operative relationship between support element 22 and base member 12 for raising and lowering support element 22 with respect to base member 12 and second jack means 28 is connected in operative relationship between support element 24 and base member 12' for raising and lowering support element 24 with respect to base member 12'. First jack means 26 is preferably positioned substantially midway along support element 22 and between sleeve members 18, 18', and second jack means 28 is preferably positioned substantially midway along support element 24 and between sleeve members 20, 20'.

Jacks 26, 28 can be manual, air, hydraulic or electric jacks, for example. The telescoping joints between supports 14, 14' and sleeve members 18, 18' and between supports 16, 16' and sleeve members 20, 20' prevent apparatus 10 from tilting end-to-end while jacks 26, 28 lift from central points along support elements 22 and 24. The telescoping joints enable only one jack on each side of apparatus 10 to provide safe and stable raising and lowering without end-to-end tilting.

Each of support elements 22, 24 defines an upper surface 32, 32', respectively, and an inwardly facing substantially vertical surface 34, 34', respectively. Apparatus 10 further includes a first platform member 36 attached to first support element 22 below upper surface 32 and projecting inwardly from surface 34 of support element 22. A second platform member 38 is attached to second support element 24 below upper surface 32' and projects inwardly from surface 34' of second support element 24 whereby a camper cabin can rest on platform members 36, 38 with lateral movement of the camper cabin restricted by inwardly facing surfaces 34, 34' extending above platform members 36, 38. Although support elements 22, 24 are shown as square tubing, it should be understood that round tubing or pipe can also be used. Platform members 36, 38 would then be attached to the round tubing to provide for inwardly facing arcuate surfaces of the round tubing extending above platform members 36, 38.

Each of platform members 36, 38 preferably extends continuously and substantially completely along the lengths of support elements 22, 24 for providing strong and stable support for the camper without damaging the camper. Each of platform members 36, 38 also preferably defines a plurality of holes 68, 68', respectively, therein for enabling the camper cabin to be attached to platform members 36, 38 by bolts or the like (not shown).

Each of transverse members 30, 30' is preferably adjustable in length to accommodate campers and pickup trucks of different widths. Transverse members 30, 30' stabilize apparatus 10 and prevent support elements 22, 24 from tilting outwardly in an unstable manner when a camper is resting on platform members 36, 38. A flexible line or chain 66 also is preferably removably connected between support elements 22, 24 for providing additional stability to apparatus 10. The adjustable feature of transverse members 30, 30' also makes it possible to disassemble apparatus 10 for storage or transportation.

Each of base members 12, 12' is also preferably adjustable in length to permit varying the positions of base members 12, 12' on the transporting vehicle or pickup truck. Each of base members 12, 12' preferably defines an inverted substantially U-shaped mid-portion 40, 40', respectively, for enabling easier access to a wheel or tire of a transporting vehicle or pickup truck upon which apparatus 10 may be mounted. The adjustable feature of base members 12, 12' permits apparatus 10 to be adjusted in position on the transporting vehicle so that U-shaped mid-portions 40, 40' of base members 12, 12' can be easily positioned for enabling access to a wheel or tire of the transporting vehicle.

Adjustment of the lengths of base members 12, 12' is also important for adjusting the positions of crosswise members 52, 52', 56, 56' and sleeve elements 54, 58 with respect to mounting brackets 70 attached to the underside of pickup truck frame 72. The engagement of crosswise members 52, 52', 56, 56' and sleeve elements 54, 58 with mounting brackets 70 enables the camper cabin to be securely held onto the truck and eliminates the need for chain and turnbuckle tie-downs.

First base member 12 preferably includes a first hollow end member 42, and a first slide element 44 is telescopically positioned with respect to end member 42 for enabling adjustment of the length of base member 12. Similarly, base member 12 preferably includes opposite hollow end member 42', and another slide element 44' is telescopically positioned with respect to end member 42' for further enabling adjustment of the length of base member 12.

Second base member 12' includes a second hollow end member 46, and a second slide element 48 is telescopically positioned with respect to end member 46 for enabling adjustment of the length of second base member 12'. Similarly, base member 12' includes an opposite hollow end member 46', and another slide element 48' is telescopically positioned with respect to end member 46' for further enabling adjustment of the length of second base member 12'. Each of end members 42, 42' and slide elements 44, 44' defines a plurality of pin or bolt-receiving holes 50 for enabling base member 12 to be adjusted and fixed at predetermined lengths by the insertion of pins or bolts 51 through holes 50. Similarly, each of end members 46, 46' and each of slide elements 48, 48' defines a plurality of pin or bolt-receiving holes 50' for enabling base member 12' to be adjusted and fixed at predetermined lengths by the insertion of pins or bolts 51' through holes 50'.

First transverse member 30 preferably includes first and second crosswise members 52, 52' extending inwardly from slide elements 44, 44', respectively, and a first sleeve element 54 is telescopically positioned with respect to crosswise members 52, 52' for enabling adjustment of transverse member 30 and of the width of apparatus 10. Similarly, second transverse member 30' includes third and fourth crosswise members 56, 56' extending inwardly from slide elements 44', 48' respectively, and a second sleeve element 58 is telescopically positioned with respect to crosswise members 56, 56' for enabling adjustment of transverse member 30' and of the width of apparatus 10.

Each of transverse members 30, 30' preferably defines a plurality of pin or bolt-receiving holes 60, 60', respectively, for enabling transverse members 30, 30' to be adjusted and fixed at predetermined lengths by the insertion of pins or bolts 61 through holes 60 and by the insertion of pins or bolts 61' through holes 60'. More specifically, holes 60 are preferably located within crosswise members 52, 52' and within sleeve element 54 of transverse member 30, and holes 60' are preferably located within crosswise members 56, 56' and within sleeve element 58 of transverse member 30'.

Apparatus 10 preferably includes four caster wheels 62, and one each of wheels 62 is attached to sleeve members 18, 18', 20 and 20' so that apparatus 10 can be easily moved about on wheels 62 when jacks 26, 28 are adjusted to predetermined positions. Each of vertical supports 14, 14', 16 and 16' is telescopically positioned within each respective one of sleeve members 18, 18', 20 and 20' to selectively allow wheels 62 to engage the ground and to enable apparatus 10 to be selectively supported by wheels 62 when jacks 26, 28 are adjusted to predetermined positions.

First sleeve member 18 and first vertical support 14, for example, each preferably defines a plurality of selectively alignable openings 64 therein for receiving a pin or the like (not shown) so that a padlock can be placed through the pin to prevent raising and lowering of apparatus 10. If desired, a similar arrangement can be provided with respect to sleeve member 20 and support 16.

Apparatus 10 can be made from pipe or tubing of metal or other comparable material.

Figure 4:
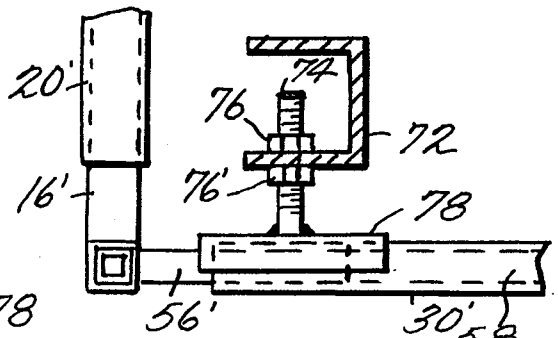
FIG. 4 is a fragmentary cross-sectional view taken along the line 4—4 in FIG. 3 and looking in the direction of the arrows.
Figure 5:
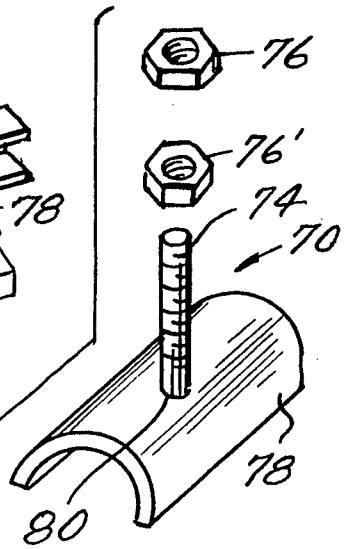
FIG. 5 is a perspective view showing a mounting bracket used as a part of the mounting system for the apparatus.
Figure 3:
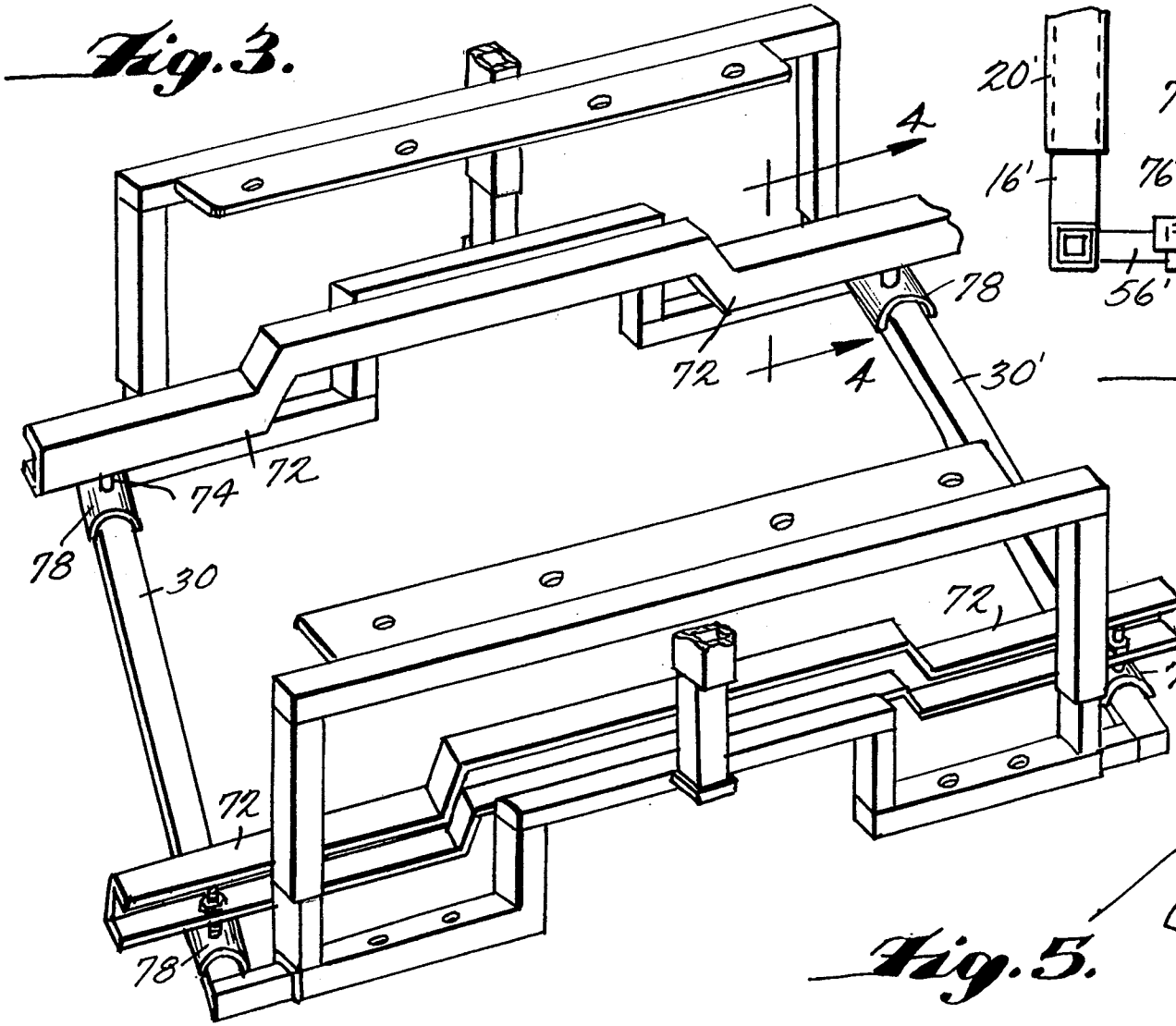
FIG. 3 is a fragmentary perspective view showing the apparatus without wheels and showing a mounting system to be used with the apparatus.

FIGS. 3–5 illustrate one preferred embodiment of a mounting system to be used with apparatus 10. The mounting system typically includes four mounting brackets 70 for attachment to frame 72 of a pickup truck or other vehicle. Each mounting bracket 70 preferably includes a bolt 74, and two nuts 76, 76' are threadably mounted onto bolt 74. A pipe section or bracket 78 is welded to one end 80 of bolt 74.

Mounting brackets 70 are connected to frame 72 by drilling holes through horizontal portions of the frame and by positioning bolt 74 within the drilled holes with nuts 76, 76' positioned above and below the frame, respectively. The vertical position of bracket 78 with respect to frame 72 can be adjusted by changing the positions of nuts 76, 76' along the length of bolt 74. The vertical adjustment of the positions of brackets 78 permits clearing of possible obstructions beneath the vehicle, such as a gas tank, differential or drive shaft which would obstruct proper positioning of transverse members 30, 30'. Each of mounting brackets 70 is firmly held in its desired position by tightening nuts 76, 76' against a horizontal section of frame 72. Mounting brackets 70 are positioned to receive transverse members 30, 30' in engagement with brackets 78, as illustrated.

It should be understood, of course, that various other types of brackets or mounting systems could be used to engage transverse members 30, 30'.

In operation, when it is desired to unload a camper cabin from a pickup truck or other vehicle onto apparatus 10, jacks 26, 28 are adjusted so that wheels 62 are positioned in noncontacting relationship with the ground. As a result, end members 42, 42', 46 and 46' and transverse members 30, 30' are positioned on the ground. Transverse members 30, 30' are adjusted in length to accommodate the width of the pickup truck or other vehicle between support elements 22, 24. Adjustment of transverse members 30, 30' is accomplished by adjusting the positions of sleeve elements 54 and 58 with respect to crosswise members 52, 52' and 56, 56', respectively. Pins or bolts 61 and 61' are then inserted into holes 60 and 60', respectively, to maintain transverse members 30 and 30' at fixed lengths.

The pickup truck or other vehicle carrying camper cabin 11 is then backed so that the rear wheels of the truck or other vehicle pass over transverse member 30'. The truck is then backed further and stopped before the rear wheels of the truck reach transverse member 30. The position of the pickup truck is adjusted with respect to apparatus 10 so that camper cabin 11 is properly positioned for support by platform members 36 and 38. In this position, transverse member 30' will be located between the front wheels and the rear wheels of the pickup truck or other vehicle and transverse member 30 will be located to the rear of the rear wheels of the truck.

Jacks 26, 28 are then raised to cause support elements 22, 24 and platform members 36, 38 to be raised until platform members 36, 38 contact the lower surfaces of conventional camper cabin 11 which extend outwardly and over the sides of the pickup truck in a conventional manner. Jacks 26, 28 are then raised further until camper cabin 11 is lifted above the pickup truck bed, and the full weight of camper cabin 11 is supported by platform members 36, 38. The pickup truck can then be driven forwardly so that the rear wheels of the pickup truck ride over transverse member 30' and until the pickup truck is clear of apparatus 10 and camper cabin 11. Transverse members 30, 30' act as stabilizing elements to prevent outward tilting of platform members 36, 38 when camper cabin 11 is resting on platform members 36, 38.

Jacks 26, 28 are then lowered to a desired position until the lower surface of the central portion of camper cabin 11 comes to rest approximately two feet above the ground. In this position, apparatus 10 provides an extremely stable support for camper cabin 11, and the camper cabin is supported by platform members 36, 38.

The stability of apparatus 10 can be further enhanced by attaching chain or flexible line 66 between support elements 22, 24. Although only one line or chain 66 is shown, it should be understood that a second line or chain could also be connected in a similar manner at the opposite ends of support elements 22, 24.

If caster wheels 62 are provided on apparatus 10, they can be vertically adjustably positioned on sleeve members 18, 18', 20, 20' so that lowering of jacks 26, 28 simultaneously results in caster wheels 62 coming to rest against the ground in a load bearing manner so that apparatus 10 is raised up onto wheels 62 and is supported on the ground by the wheels. Wheels 62 can also be positioned on sleeve members 18, 18', 20, 20' so that the wheels will not contact the ground, permitting transverse members 30, 30' to rest against the ground in a load bearing manner. Camper cabin 11 will rest on platform members 36 and 38 and apparatus 10 will be supported on the ground by base members 12, 12' and transverse members 30, 30'.

Although not illustrated, the vertical positions of caster wheels 62 with respect to sleeve members 18, 18' 20 and 20' can be accomplished in many ways. For example, adjustable clamps (not shown) can be attached to sleeves 18, 18' 20 and 20' and to each of wheels 62 for slidably positioning the wheels on each of sleeves 18, 18' 20 and 20'.

When camper cabin 11 is supported by apparatus 10, the camper cabin is stable enough to be occupied, and the camper cabin can be used while the pickup truck or other vehicle is being used for other purposes. As a result, users of the camper cabin 11 and apparatus 10 are able to retain a camping spot for the camper while using the truck for sightseeing or other purposes. The use of caster wheels 62 also makes it possible to move camper cabin 11 about when the camper cabin is not mounted on the truck. The use of apparatus 10 also provides for safe long-term storage for camper cabin 11 when the camper cabin is not being used or occupied.

Contrary to some previously known camper supports, apparatus 10 permits safe occupancy of camper cabin 11 while the camper cabin is supported by apparatus 10 without the use of additional blocks to support the cabin. Some previously known camper supports require additional support blocks beneath the camper to avoid bending of the corner jacks and to prevent damaging the camper, even if the camper is not occupied. In some previously known support arrangements, two portable jacks are used to raise, lower and support the camper cabin. Such an arrangement is notoriously unstable and may be dangerous. By use of apparatus 10, camper cabin 11 can be used when it is supported by apparatus 10 just as if it were mounted on a truck.

The use of built-in jacks 26, 28, in cooperation with sleeve members 18, 18', 20 and 20' that telescope with respect to vertical supports 14, 14', 16 and 16' make raising and lowering of apparatus 10 with camper cabin 11 thereon almost effortless and completely safe and stable. The use of platform members 36, 38 distributes the weight of camper cabin 11 over a wider surface and is less likely to damage the camper than other types of jacks currently in use which provide support for the camper over less surface area. This is especially important for older campers that may have dry rot or other structural weaknesses.

If it is desired to transport apparatus 10 along with camper cabin 11 on the pickup truck or other vehicle, platform members 36, 38 can be attached to camper cabin 11 by the use of bolts or other conventional fastening means passing through holes 68, 68' in platform members 36, 38 and into camper cabin 11.

Jacks 26, 28 can be used to adjust the side-to-side level of camper cabin 11 while the camper is mounted on apparatus 10, and jacks 26, 28 can be used to adjust the side-to-side level of the camper while the camper is mounted on a truck. The telescoping relationship between sleeve members 18, 18', 20 and 20' and vertical supports 14, 14', 16 and 16' prevents apparatus 10 from tilting end-to-end while jacks 26, 28 provide lifting only from center points of support elements 22, 24. This configuration allows only one jack to be used on each side of apparatus 10.

Alignable openings 64 within sleeve member 18 and within vertical support 14 (not shown) permit a pin (not shown) to be inserted through openings 64, and a padlock (not shown) can be placed through the pin to prevent raising and lowering of jack 26. A similar arrangement can be provided with respect to sleeve member 20 and vertical support 16, for example, to prevent operation of jack 28. This will provide security and will make theft of apparatus 10 very difficult.

When loading camper cabin 11 from apparatus 10 onto a pickup truck or other vehicle, jacks 26, 28 are raised and adjusted so that camper cabin 11 is at a height to be received by the bed of a pickup truck. The truck is then backed so that the rear wheels of the truck pass over transverse member 30'. The truck is backed further until camper cabin 11 is suitably positioned to be received by the bed of the truck and with the rear wheels of the truck positioned forwardly of transverse member 30.

Jacks 26, 28 are then lowered until camper cabin 11 comes to rest on the bed of the truck. If it is desired to transport apparatus 10 along with camper cabin 11 on the truck, the camper cabin will have been attached to platform members 36, 38, as previously explained. If jacks 26, 28 are then lowered further, base members 12, 12' and transverse members 30, 30' will be lifted off the ground so that apparatus 10 will be suspended from camper cabin 11. Transverse members 30, 30' will be drawn up into mounting brackets 70 attached to lower frame 72 of the truck to secure camper cabin 11 in place on the truck for transportation. Jacks 26, 28 draw camper cabin 11 tightly down on the bed of the truck by action of transverse members 30, 30' against brackets 70 mounted under frame 72 of the truck. This is a very important feature and advantage of the invention.

Transverse member 30 will be positioned off the ground and behind the rear wheels of the pickup truck in engagement with a mounting bracket attached beneath the truck frame, and transverse member 30' will be positioned off the ground and between the rear wheels and the front wheels of the pickup truck in engagement with another mounting bracket attached beneath the truck frame. The pickup truck can then be driven to transport camper cabin 11, and apparatus 10 will be transported by the pickup truck along with the camper cabin. This provides a convenient way of transporting apparatus 10 and enables apparatus 10 to be quickly utilized whenever it is desired to remove the camper cabin from the truck.

If apparatus 10 is not connected to camper cabin 11 so that apparatus 10 will not be transported by the truck with camper cabin 11, jacks 26, 28 are lowered further after the camper cabin has been positioned to rest on the bed of the truck. The truck can then be driven in a forward direction so that the rear wheels of the truck ride over transverse member 30', and apparatus 10 will be left behind.

Transverse members 30, 30' are adjustable in length as previously described. The use of sleeve elements 54, 58 enables crosswise members 52, 52', 56 and 56' to be relatively short in length so that apparatus 10 can be broken down into two conveniently sized pieces by removable of sleeve elements 54, 58. This permits apparatus 10 to be easily stored and transported when not in use. The adjustable feature of transverse members 30, 30' also allows apparatus 10 to be adjusted to fit any size camper cabin.

U-shaped mid-portions 40, 40' of base members 12, 12' permit access to the rear wheels of the pickup truck or transporting vehicle. This can be important in the event of a puncture or other problem with a rear wheel or tire of the transporting vehicle. The adjustable feature of base members 12, 12' by use of slide elements 44, 44', 48 and 48' enables adjustment of the positions of U-shaped mid-portions 40, 40' so that they can be properly positioned with respect to the rear wheels of the transporting vehicle.

This invention provides a camper cabin supporting and lifting apparatus which makes loading and unloading of a camper cabin faster, easier, safer and more stable than camper supports now in use. Loading or unloading of camper cabin 11 with respect to apparatus 10 can be done manually or by use of power assisted jacks 26, 28. Apparatus 10 is adjustable to accommodate various size camper cabins, and apparatus 10 can be taken on the road with the camper cabin or can be left where the camper is usually stored. Apparatus 10 is extremely strong and stable and puts less stress on the camper cabin than previously used camper supports where corner mount jacks usually bend when extended and often damage the camper at the mounting points, especially as the camper gets older. Apparatus 10 also avoids the problem of cable and winch type jacks which tend to tilt into the camper and damage the sides of the camper, and such cable and winch type jacks are not stable enough to permit use of the camper without additional blocking underneath when the camper is not mounted on the truck or other transporting vehicle.

The invention in its broader aspects is not limited to the specific details shown and described, and departures may be made from such details without departing from the principles of the invention and without sacrificing its chief advantages.

What is claimed is:

1. Apparatus for supporting and lifting a wheelless, vehicle-mounted camper cabin, said apparatus comprising:

first and second opposed base members;

first and second vertical supports extending upwardly from said first base member;

third and fourth vertical supports extending upwardly from said second base member;

first and second sleeve members telescopically positioned with respect to said first and second supports, respectively;

third and fourth sleeve members telescopically positioned with respect to said third and fourth supports, respectively;

a first support element extending between said first and second sleeve members;

a second support element extending between said third and fourth sleeve members;

first jack means in operative relationship with said first support element for raising and lowering said first support element;

second jack means in operative relationship with said second support element for raising and lowering said second support element;

first and second transverse members extending between said base members;

said first jack means in operative relationship between said first support element and said first base member for raising and lowering said first support element with respect to said first base member;

said second jack means in operative relationship between said second support element and said second base member for raising and lowering said second support element with respect to said second base member;

said first jack means positioned substantially midway along said first support element and between said first and second sleeve members, and said second jack means positioned substantially midway along said second support element and between said third and fourth sleeve members; and wherein each of said first and second support elements defines an upper surface and an inwardly facing surface, said apparatus further including a first platform member attached to said first support element below said upper-surface and projecting inwardly from said inwardly facing surface of said first support element, and a second platform member attached to said second support element below said upper surface and projecting inwardly from said inwardly facing surface of said second support element, whereby a camper cabin can rest on said platform members with lateral movement of said camper cabin restricted by said inwardly facing surfaces extending above said platform members.

2. Apparatus as in claim 1 wherein each of said transverse members is adjustable in length.

3. Apparatus as in claim 2 wherein each of said base members is adjustable in length.

4. Apparatus as in claim 3 wherein each of said base members defines an inverted substantially U-shaped mid-portion for enabling easier access to a wheel or tire of a vehicle upon which said apparatus may be mounted.

5. Apparatus as in claim 3 wherein each of said transverse members defines a first plurality of pin or bolt-receiving holes for enabling said adjustable transverse members to be fixed at predetermined lengths.

6. Apparatus as in claim 5 wherein each of said base members defines a second plurality of pin or bolt-receiving holes for enabling said adjustable base members to be fixed at predetermined lengths.

7. Apparatus as in claim 6 wherein said first base member includes a first hollow end member and a first slide element telescopically positioned with respect to said first end member for enabling adjustment of the length of said first base member, and wherein said second base member includes a second hollow end member and a second slide element telescopically positioned with respect to said second end member for enabling adjustment of the length of said second base member.

8. Apparatus as in claim 7 wherein each of said first and second slide elements and said first and second hollow end members define a predetermined number of said second plurality of pin or bolt-receiving holes therein.

9. Apparatus as in claim 8 wherein said first transverse member includes first and second crosswise members extending inwardly from said first and second slide elements, respectively, and a first sleeve element telescopically positioned with respect to said first and second crosswise members for enabling adjustment of the width of said apparatus.

10. Apparatus as in claim 9 wherein said first base member includes a third hollow end member and a third slide element telescopically positioned with respect to said third end member for enabling adjustment of the length of said first base member, and wherein said second base member includes a fourth hollow end member and a fourth slide element telescopically positioned with respect to said fourth end member for enabling adjustment of the length of said second base member.

11. Apparatus as in claim 10 wherein each of said third and fourth slide elements and said third and fourth hollow end members define a predetermined number of said second plurality of pin or bolt-receiving holes therein.

12. Apparatus as in claim 11 wherein said second transverse member includes third and fourth crosswise members extending inwardly from said third and fourth slide elements, respectively, and a second sleeve element telescopically positioned with respect to said third and fourth crosswise members for enabling adjustment of the width of said apparatus.

13. Apparatus as in claim 12 further including a flexible line or chain connected between said first and second support elements for providing stability to said apparatus.

14. Apparatus as in claim 1 wherein each of said first and second platform members defines a plurality of holes therein for enabling said camper cabin to be attached to said platform members by bolts.

15. Apparatus as in claim 1 wherein each of said first and second platform members extends substantially completely along the lengths of said first and second support elements, respectively.

16. Apparatus for supporting and lifting a wheelless, vehicle-mounted camper cabin, said apparatus comprising:

first and second opposed base members;

first and second vertical supports extending upwardly from said first base member;

third and fourth vertical supports extending upwardly from said second base member;

first and second sleeve members telescopically positioned with respect to said first and second supports, respectively;

third and fourth sleeve members telescopically positioned with respect to said third and fourth supports, respectively;

a first support element extending between said first and second sleeve members;

a second support element extending between said third and fourth sleeve members;

first jack means in operative relationship with said first support element for raising and lowering said first support element;

second jack means in operative relationship with said second support element for raising and lowering said second support element;

first and second transverse members extending between said base members; and a first platform member attached to said first support element and a second platform member attached to said second support element, each of said first and second platform members defining a plurality of holes therein for enabling said camper cabin to be attached to said platform members by bolts.

17. Apparatus as in claim 16 further including a mounting system for attachment to a frame of said vehicle, said mounting system comprising a plurality of mounting brackets for attachment to said vehicle frame in predetermined locations and for receiving and engaging said transverse members when said first and second jack means are adjusted to predetermined positions while said camper cabin is attached to said platform members.

18. Apparatus as in claim 16 wherein each of said first and second platform members extends substantially completely along the length of said first and second support elements, respectively.

* * * * *